US010822882B2

(12) United States Patent
Brown

(10) Patent No.: US 10,822,882 B2
(45) Date of Patent: Nov. 3, 2020

(54) DOWNHOLE APPARATUS AND METHOD OF USE

(71) Applicants: PEAK WELL SYSTEMS PTY LTD, Bayswater (AU); PEAK WELL SYSTEMS LIMITED, Aberdeen (GB)

(72) Inventor: Gareth Edward George Brown, Ellon (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 195 days.

(21) Appl. No.: 16/066,049

(22) PCT Filed: Dec. 23, 2016

(86) PCT No.: PCT/GB2016/054066
§ 371 (c)(1),
(2) Date: Jun. 25, 2018

(87) PCT Pub. No.: WO2017/109510
PCT Pub. Date: Jun. 29, 2017

(65) Prior Publication Data

US 2019/0368274 A1 Dec. 5, 2019

(30) Foreign Application Priority Data

Dec. 23, 2015 (GB) ..... 1522725.9
Dec. 23, 2015 (GB) ..... 1522746.5

(51) Int. Cl.
*E21B 29/00* (2006.01)
*B23D 21/14* (2006.01)
(Continued)

(52) U.S. Cl.
CPC ..... *E21B 10/32* (2013.01); *E21B 7/28* (2013.01); *E21B 29/005* (2013.01); *E21B 47/00* (2013.01)

(58) Field of Classification Search
CPC ..... E21B 29/005; B26D 3/163; B23D 21/14
(Continued)

(56) References Cited

U.S. PATENT DOCUMENTS 9,043 A 6/1852 Wright
758,186 A 4/1904 Mabrey
(Continued)

FOREIGN PATENT DOCUMENTS

CH 295473 A 12/1953
DE 814546 A 9/1951
(Continued)

OTHER PUBLICATIONS

International Search and Written Opinion issued in the related PCT Application PCT/GB2016/054064, dated May 8, 2017 (11 pages).
(Continued)

*Primary Examiner* — Kenneth L Thompson
(74) *Attorney, Agent, or Firm* — Eileen Pape

(57) ABSTRACT

The invention provides a downhole apparatus and method of use. The apparatus comprises a plurality of elements assembled together to form a ring structure oriented in a plane around a longitudinal axis and a drive mechanism for effecting rotation of the ring structure with respect to a wellbore or subterranean formation. The ring structure is operable to be moved between a collapsed condition and a first expanded condition by movement of the plurality of elements, and the ring structure comprises one or more surfaces or formations for cutting and/or removal of material from the wellbore or subterranean formation.

24 Claims, 6 Drawing Sheets

(51) Int. Cl.
*E21B 10/32* (2006.01)
*E21B 7/28* (2006.01)
*E21B 47/00* (2012.01)

(58) Field of Classification Search
USPC ..... 83/178; 30/103–108
See application file for complete search history.

(56) References Cited

U.S. PATENT DOCUMENTS

| | | | | |
|---|---|---|---|---|
| 865,998 | A | 9/1907 | Cook | |
| 2,287,205 | A | 6/1942 | Stone | |
| 2,609,836 | A | 9/1952 | Knox | |
| 2,701,615 | A | 2/1955 | Riordan, Jr. | |
| 3,572,627 | A | 3/1971 | Jones | |
| 3,603,411 | A * | 9/1971 | Link | E21B 10/66 175/259 |
| 3,915,424 | A | 10/1975 | LeRouax | |
| 4,460,150 | A | 7/1984 | Turlak et al. | |
| 4,842,082 | A | 6/1989 | Springer | |
| 5,341,888 | A | 8/1994 | Deschutter | |
| 5,507,465 | A | 4/1996 | Borle | |
| 5,678,635 | A | 10/1997 | Dunlap et al. | |
| 5,685,078 | A * | 11/1997 | Obst | B26D 3/163 30/106 |
| 6,598,672 | B2 | 7/2003 | Bell et al. | |
| 7,290,603 | B2 | 11/2007 | Hiorth et al. | |
| 7,389,822 | B2 | 6/2008 | Lohbeck et al. | |
| 7,921,921 | B2 | 4/2011 | Bishop et al. | |
| 7,992,634 | B2 | 8/2011 | Angelle et al. | |
| 8,083,001 | B2 | 12/2011 | Conner et al. | |
| 8,167,033 | B2 | 5/2012 | White | |
| 8,459,344 | B1 | 6/2013 | Stone | |
| 8,555,980 | B1 * | 10/2013 | Powell | E21B 43/0122 166/363 |
| 8,733,453 | B2 * | 5/2014 | Guerrero | E21B 4/18 166/207 |
| 9,038,723 | B2 * | 5/2015 | Trudeau | B23D 21/14 166/298 |
| 9,051,812 | B2 | 6/2015 | Clemens et al. | |
| 9,806,566 | B2 | 10/2017 | Nagao et al. | |
| 10,258,361 | B2 * | 4/2019 | Dickerson | A61B 17/320068 |
| 10,487,614 | B2 * | 11/2019 | MacDonald | E21B 33/1216 |
| 2010/0071908 | A1 | 3/2010 | Bishop et al. | |
| 2011/0061857 | A1 | 3/2011 | White | |
| 2011/0127131 | A1 | 6/2011 | Simons et al. | |
| 2013/0112398 | A1 | 5/2013 | White | |
| 2013/0168076 | A1 | 7/2013 | Davis | |
| 2013/0269929 | A1 | 10/2013 | Smith | |
| 2013/0319654 | A1 | 12/2013 | Hiorth et al. | |
| 2016/0123100 | A1 | 5/2016 | Tse | |
| 2019/0264547 | A1 * | 8/2019 | Cornelissen | E21B 43/105 |
| 2019/0352988 | A1 * | 11/2019 | Brown | E21B 33/1216 |
| 2019/0352997 | A1 * | 11/2019 | Brown | E21B 33/128 |
| 2019/0360288 | A1 * | 11/2019 | Brown | E21B 33/1216 |
| 2019/0368274 | A1 * | 12/2019 | Brown | E21B 29/005 |

FOREIGN PATENT DOCUMENTS

| | | | |
|---|---|---|---|
| DE | 1775899 | A1 | 10/1971 |
| EP | 0533326 | A1 | 3/1993 |
| FR | 2996816 | A1 | 4/2014 |
| GB | 191010637 | A | 3/1911 |
| GB | 1452272 | A | 10/1976 |
| GB | 2127068 | A | 4/1984 |
| GB | 2488152 | A | 8/2012 |
| JP | S643330 | A1 | 1/1989 |
| JP | 2000120365 | A | 4/2000 |
| WO | 2017109506 | A2 | 6/2017 |
| WO | 2017109508 | A1 | 6/2017 |
| WO | 2017109509 | A1 | 6/2017 |
| WO | 2017109510 | A1 | 6/2017 |
| WO | 2017109511 | A1 | 6/2017 |

OTHER PUBLICATIONS

International Preliminary Report on Patentability issued in the related PCT Application PCT/GB2016/054064, dated Jun. 26, 2018 (7 pages).
Combined Search and Examination Report issued in the related GB Application 1622148.3, dated Jun. 21, 2017 (9 pages).
Examination Report issued in the related GB Application 1622148.3, dated Jul. 24, 2019 (4 pages).
International Search and Written Opinion issued in the related PCT Application PCT/GB2016/054065, dated May 8, 2017 (10 pages).
International Preliminary Report on Patentability issued in the related PCT Application PCT/GB2016/054065, dated Jun. 26, 2018 (6 pages).
Combined Search and Examination Report issued in the related GB Application 1622150.9, dated Mar. 31, 2017 (5 pages).
International Search and Written Opinion issued in the related PCT Application PCT/GB2016/054066, dated May 8, 2017 (9 pages).
International Preliminary Report on Patentability issued in the related PCT Application PCT/GB2016/054066, dated Jun. 26, 2018 (6 pages).
Combined Search and Examination Report issued in the related GB Application 1622151.9, dated Apr. 27, 2017 (5 pages).
Examination Report issued in the related GB Application 1622151.9, dated Jan. 24, 2019 (3 pages).
International Search and Written Opinion issued in the related PCT Application PCT/GB2016/054067, dated May 8, 2017 (11 pages).
International Preliminary Report on Patentability issued in the related PCT Application PCT/GB2016/054067, dated Jun. 26, 2018 (7 pages).
Combined Search and Examination Report issued in the related GB Application 1622152.5, dated Apr. 27, 2017 (7 pages).
International Search and Written Opinion issued in the related PCT Application PCT/GB2016/054058, dated Jun. 21, 2017 (12 pages).
International Preliminary Report on Patentability issued in the related PCT Application PCT/GB2016/054058, dated Jun. 26, 2018 (8 pages).
Combined Search and Examination Report issued in the related GB Application 1622147.5, dated Apr. 27, 2017 (7 pages).
Examination Report issued in the related GB Application 1622147.5, dated Jan. 31, 2019 (2 pages).
Office Action received in U.S. Appl. No. 16/066,038 dated Feb. 19, 2020, 19 pages.
Office Action received in U.S. Appl. No. 16/066,044 dated Feb. 20, 2020, 19 pages.
Office Action received in U.S. Appl. No. 16/066,046 dated Mar. 2, 2020, 18 pages.

* cited by examiner

DOWNHOLE APPARATUS AND METHOD OF USE

This application is the U.S. National Stage of International Application No. PCT/GB2016/054066, filed Dec. 23, 2016. This application also claims the benefit of GB patent application No. 1522746.5, and GB patent application No. 1522725.9 filed Dec. 23, 2015, the contents of which are hereby incorporated by reference in their entirety.

The present invention relates to a downhole apparatus and methods of use, and in particular aspects, to a rotary expanding and collapsing apparatus for use in the cutting and/or removal of material from a wellbore or subterranean formation. The invention also relates to tools and devices incorporating the expansion apparatus and methods of use. Preferred embodiments of the invention relate to drilling, milling, cutting and reaming apparatus incorporating the apparatus and methods of use.

BACKGROUND TO THE INVENTION

In the field of wellbore drilling and construction, such as in the hydrocarbon exploration and production industry, it is known to provide equipment for the cutting and/or removal of material from a wellbore or subterranean formation which is capable of being expanded in situ in a wellbore.

SUMMARY OF THE INVENTION

It is amongst the claims and objects of the invention to provide a downhole apparatus for use in the cutting and/or removal of material from a wellbore or subterranean formation and methods of use which obviate or mitigate disadvantages of previously proposed apparatus and methods.

It is amongst the aims and objects of the invention to provide an expanding or collapsing apparatus for use in the cutting and/or removal of material from a wellbore or subterranean formation, which obviates or mitigates disadvantages of prior art oilfield apparatus.

Further aims and objects of the invention will be apparent from reading the following description.

According to a first aspect of the invention, there is provided a downhole apparatus comprising:

a plurality of elements assembled together to form a ring structure oriented in a plane around a longitudinal axis;

a drive mechanism for effecting rotation of the ring structure with respect to a wellbore or subterranean formation;

wherein the ring structure is operable to be moved between a collapsed condition and a first expanded condition by movement of the plurality of elements on actuation by an axial force;

and wherein the ring structure comprises one or more surfaces or formations for cutting and/or removal of material from the wellbore or subterranean formation.

The collapsed condition may be a first condition of the apparatus, and the expanded condition may be a second condition of the apparatus. Thus the apparatus may be normally collapsed, and may be actuated to be expanded.

The plane of the ring structure may be perpendicular to the longitudinal axis. The ring structure, and its plane of orientation, may be operable to move on the apparatus during expansion and/or collapsing. The movement of the plane may be an axial sliding movement, during expanding and/or collapsing of the ring structure.

In the collapsed condition, the elements may be arranged generally at collapsed radial positions, and may define a collapsed outer diameter and inner diameter of the ring structure.

In the expanded condition, the elements may be arranged generally at expanded radial positions, and may define an expanded outer diameter and inner diameter of the ring structure. The ring surface may be located at or on the expanded outer diameter of the ring structure, or may be located at or on the collapsed inner diameter of the ring structure.

In the collapsed condition, the elements may occupy a collapsed annular volume, and in the expanded condition the elements may occupy an expanded annular volume. The collapsed annular volume and the expanded annular volume may be discrete and separated volumes, or the volumes may partially overlap.

The elements may be configured to move between their expanded and collapsed radial positions in a path which is tangential to a circle described around and concentric with the longitudinal axis.

Preferably, each element of the ring structure comprises a first contact surface and second contact surface respectively in abutment with first and second adjacent elements. The elements may be configured to slide relative to one another along their respective contact surfaces.

The first contact surface and/or the second contact surface may be oriented tangentially to a circle described around and concentric with the longitudinal axis. The first contact surface and the second contact surface are preferably non-parallel. The first contact surface and the second contact surface may converge towards one another in a direction towards an inner surface of the ring structure (and may therefore diverge away from one another in a direction away from an inner surface of the ring structure).

At least some of the elements are preferably provided with interlocking profiles for interlocking with an adjacent element. Preferably the interlocking profiles are formed in the first and/or second contact surfaces. Preferably, an element is configured to interlock with a contact surface of an adjacent element. Such interlocking may prevent or restrict separation of assembled adjacent elements in a circumferential and/or radial direction of the ring structure, while enabling relative sliding movement of adjacent elements.

Preferably, at least some of, and more preferably all of, the elements assembled to form a ring are identical to one another, and each comprises an interlocking profile which is configured to interlock with a corresponding interlocking profile on another element. The interlocking profiles may comprise at least one recess such as groove, and at least one protrusion, such as a tongue or a pin, configured to be received in the groove. The interlocking profiles may comprise at least one dovetail recess and dovetail protrusion.

The first and second contact surfaces of an element may be oriented on first and second planes, which may intersect an inner surface of the ring at first and second intersection lines, such that a sector of an imaginary cylinder is defined between the longitudinal axis and the intersection lines. The central angle of the sector may be 45 degrees or less. Such a configuration corresponds to eight or more elements assembled together to form the ring structure.

Preferably, the central angle of the sector is 30 degrees or less, corresponding to twelve or more elements assembled together to form the ring. More preferably, the central angle of the sector is in the range of 10 degrees to 20 degrees, corresponding to eighteen to thirty-six elements assembled together to form the ring. In a particular preferred embodiment, the central angle of the sector is 15 degrees, corresponding to twenty-four elements assembled together to form the ring structure.

Preferably, an angle described between the first contact and second contact surfaces corresponds to the central angle of the sector. Preferably therefore, an angle described between the first contact and second contact surfaces is in the range of 10 degrees to 20 degrees, and in a particular preferred embodiment, the angle described between the first contact and second contact surfaces is 15 degrees, corresponding to twenty-four elements assembled together to form the ring structure.

In a preferred embodiment, the apparatus comprises a support surface for the ring structure. The support surface may be the outer surface of a mandrel or tubular. The support surface may support the ring structure in a collapsed condition of the apparatus.

The support surface may be the inner surface of a mandrel or tubular. The support surface may support the ring structure in an expanded condition of the apparatus.

In some embodiments, the apparatus is operated in its expanded condition, and in other embodiments, the apparatus is operated in its collapsed condition. Preferably, elements forming the ring structure are mutually supportive in an operating condition of the apparatus. Where the operating condition of the apparatus its expanded condition (i.e. when the apparatus is operated in its expanded condition), the ring structure is preferably a substantially solid ring structure in its expanded condition, and the elements may be fully mutually supported.

The apparatus may comprise a formation configured to impart a radial expanding or collapsing force component to the elements of a ring structure from an axial actuation force. The apparatus may comprise a pair of formations configured to impart a radial expanding or collapsing force component to the elements of a ring structure from an axial actuation force. The formation (or formations) may comprise a wedge or wedge profile, and may comprise a cone wedge or wedge profile.

Preferably the formation (or formations) are configured to transmit torque to the ring structure. The formation (or formations) may comprise a splined arrangement.

The apparatus may comprise a biasing means, which may be configured to bias the ring structure to its collapsed condition. The biasing means may comprise a circumferential spring, a garter spring, or a spiral retaining ring. The biasing means may be arranged around an outer surface of a ring structure, to bias it towards a collapsed condition. One or more elements may comprise a formation such as a groove for receiving the biasing means. Preferably, grooves in the elements combine to form a circumferential groove in the ring structure. Multiple biasing means may be provided on the ring structure.

The apparatus may be configured as a mill bit, a drill bit, or a cutting tool. The apparatus may be configured as a reamer or an underreamer. The apparatus may be configured as a washover tool or a hole opener. The apparatus may be configured as a casing drilling bit.

The apparatus may also be used in conjunction with a stabilising and/or centring tool, which may comprise a plurality of elements assembled together to form a ring structure operable to be moved between an expanded condition and a collapsed condition by movement of the plurality of elements. The ring structure of the stabilising tool may be oriented in a plane around a longitudinal axis. The plurality of elements may be operable to be moved between the expanded and collapsed conditions by sliding with respect to one another in the plane of the ring structure, in a direction tangential to a circle concentric with the ring structure, and/or by sliding of the elements with respect to an adjacent pair of elements. Thus the stabilising or centring tool may be a variable diameter tool. The tool may be provided with a bearing assembly to facilitate rotation of a mandrel with respect to the expanding ring structure, or to permit rotation of a drilling, milling or cutting tool. The diameter of the tool can be controlled to provide a centralising and/or stabilising engagement force to support the wellbore operation.

According to a further aspect of the invention, there is provided a method of use of the apparatus in an operation selected from the group comprising: a milling operation, a drilling operation; a cutting operation; a reaming operation; an underreaming operation; a washover operation; a hole opening operation; or a casing drilling operation.

The method may comprise dynamically expanding and/or collapsing the ring structure of the apparatus in situ in the wellbore or subterranean formation. The method may comprise dynamically expanding and/or collapsing the rings structure in response to operational parameters sensed, logged, measured or monitored during the operation.

According to a further aspect of the invention, there is provided a downhole apparatus comprising:

a plurality of elements assembled together to form a ring structure oriented in a plane around a longitudinal axis;

a drive mechanism for effecting rotation of the ring structure with respect to a wellbore or subterranean formation;

wherein the ring structure is operable to be moved between a collapsed condition and a first expanded condition by movement of the plurality of elements;

and wherein the ring structure comprises one or more surfaces or formations for cutting and/or removal of material from the wellbore or subterranean formation.

Embodiments of the further aspects of the invention may include one or more features of the first aspect of the invention or its embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1A:
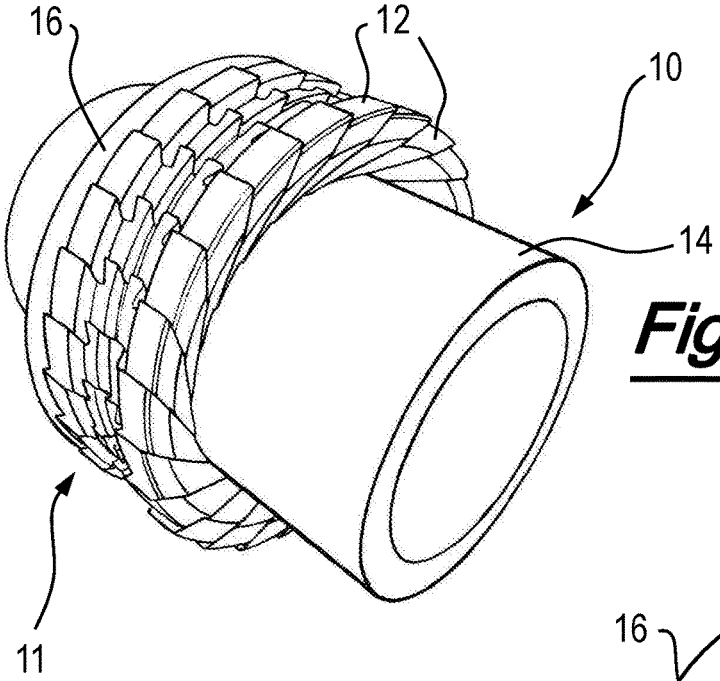
FIGS. 1A to FIG. 1D are respectively perspective, first end, part sectional and second end views of an apparatus useful for understanding the invention, shown in a collapsed condition.

Referring firstly to FIGS. 1A to 4F, the principles of the invention will be described with reference to an expanding apparatus which is useful for understanding the invention and its embodiments. In the arrangement of FIGS. 1A to 4F, the expanding apparatus, generally depicted at 10, comprises an expanding ring structure configured to be expanded from a first collapsed or unexpanded condition (shown in FIGS. 1A to 1D) and a second expanded condition (shown in FIGS. 2A to 2D). The apparatus of this and other embodiments may be referred to as "expanding apparatus" for convenience, as they are operable to move to an expanded state from a normal collapsed state. However, the apparatus may equally be referred to as a collapsing apparatus, or an expanding or collapsing apparatus, as they are capable of being expanded or collapsed depending on operational state.

The expanding apparatus 10 comprises a plurality of elements 12 assembled together to form a ring structure 11. The elements 12 define an inner ring surface which is supported by the outer surface of cylinder 14. Each element comprises an inner surface 20, an outer surface 21 and first and second contact surfaces 22, 23. The first and second contact surfaces are oriented in non-parallel planes, which are tangential to a circle centred on the longitudinal axis of the apparatus. The planes converge towards the inner surface of the element. Therefore, each element is in the general form of a wedge, and the wedges are assembled together in a circumferentially overlapping fashion to form the ring structure 11. In use, the first and second contact surfaces of adjacent elements are mutually supportive.

Figure 3A:
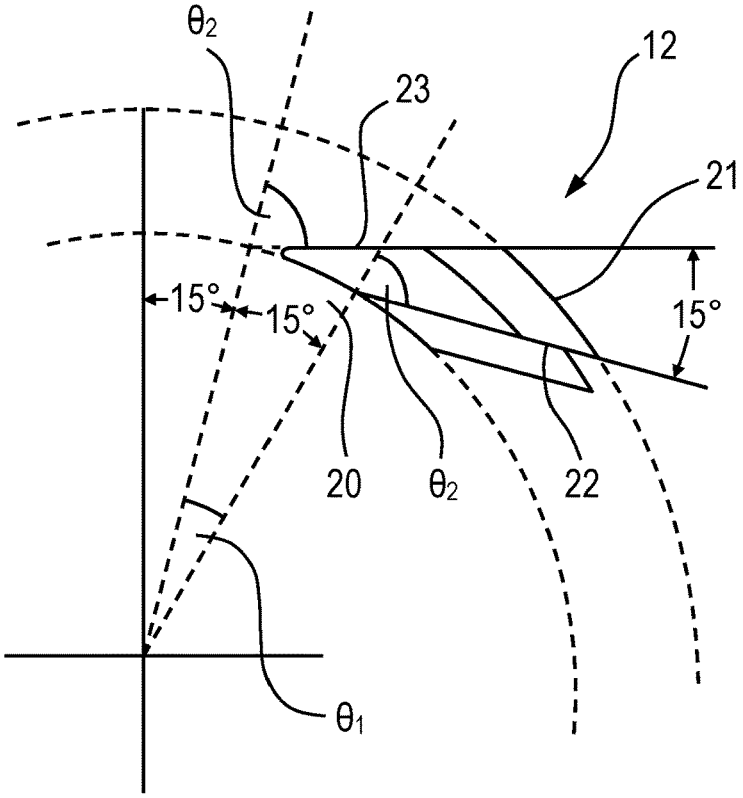
FIGS. 3A and 3B are geometric representations of an element of the apparatus of FIGS. 1A and 1D, shown from one side.
Figure 3B:
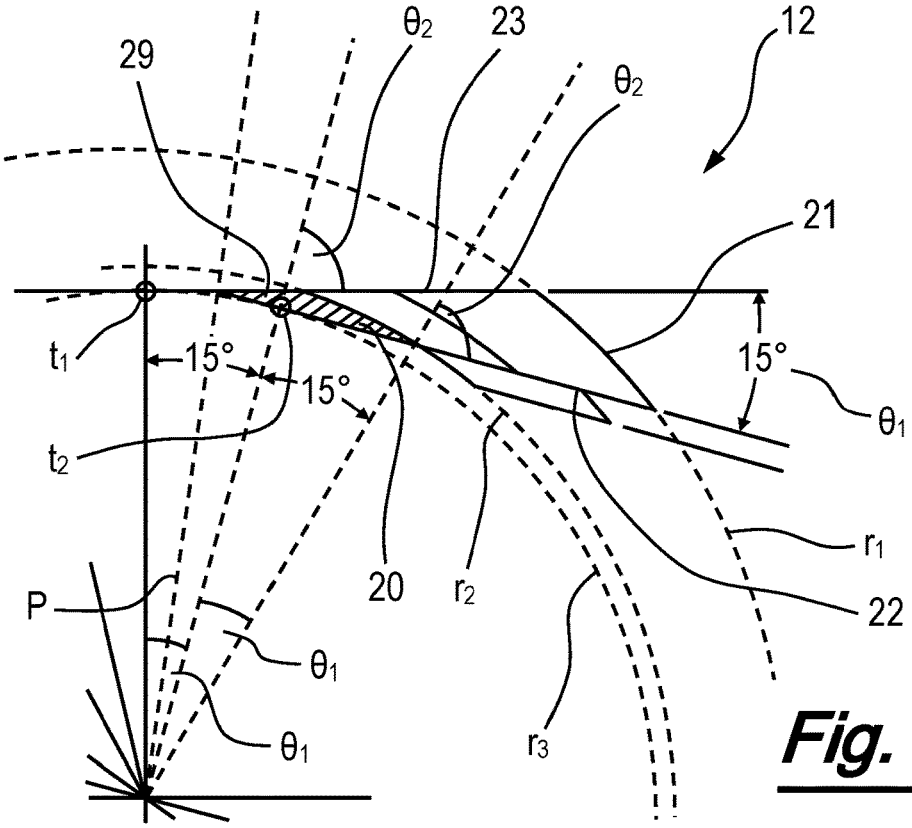
Figure 4A:
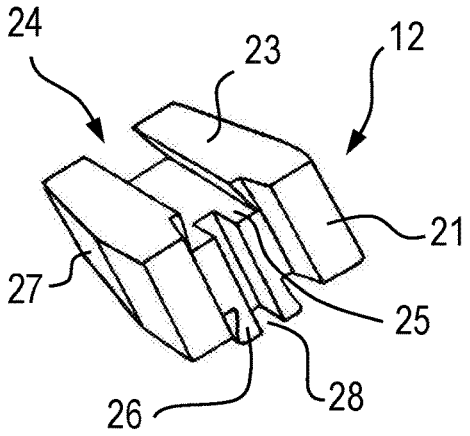
FIGS. 4A to FIG. 4F are respectively first perspective, second perspective, plan, first end, lower, and second end views of an element of the apparatus of FIGS. 1A to 1D.
Figure 4B:
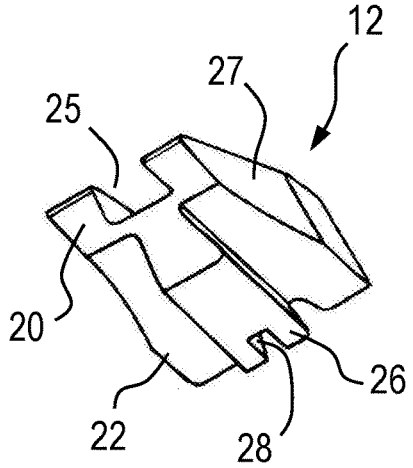
Figure 4C:
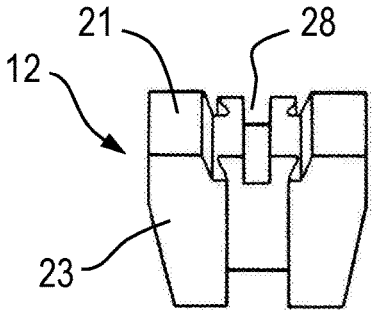
Figure 4D:
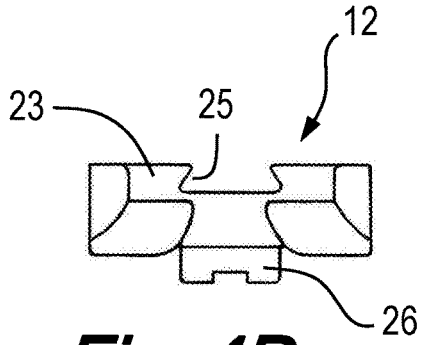
Figure 4E:
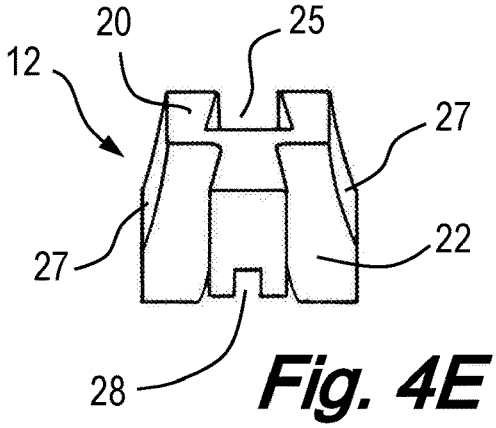
Figure 4F:
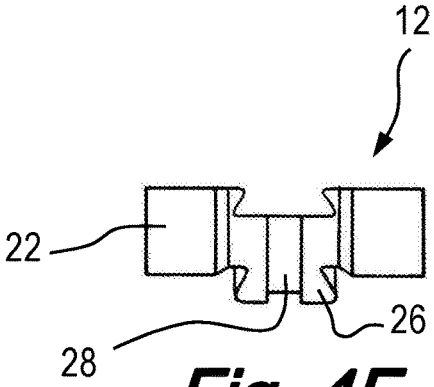

As shown in FIG. 3B, each element is based on a notional wedge-shaped segment of a ring centred on an axis, with each notional wedge-shaped segment being inclined with respect to the radial direction of the ring. The nominal outer diameter of the segment is at the optimum expansion condition of the ring (with radius shown at $r_1$).

The orientation planes of the first and second contact surfaces of the element are tangential to a circle with radius $r_3$ concentric with the ring at points $t_1$, $t_2$. The angle described between the tangent points is equal to the angle $\theta_1$ of the segment. The orientation planes of the first and second contact surfaces of each notional wedge-shaped segment intersect one another on a radial plane P which bisects radial planes located at the tangent points (i.e. is at an angle of $\theta_1/2$ to both). This intersection plane P defines the expanding and collapsing path of the segment.

Figure 1B:
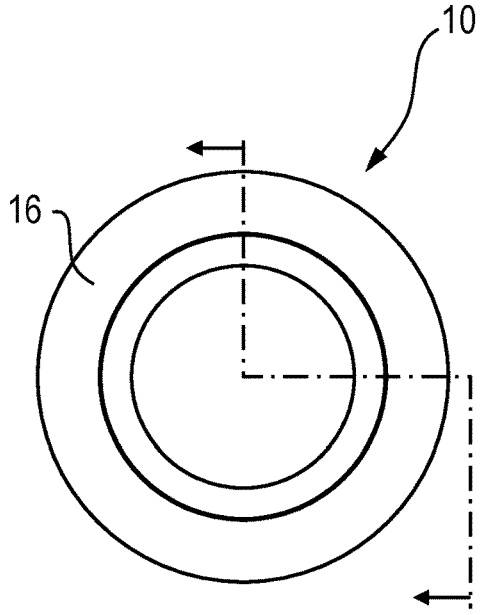
Figure 1D:
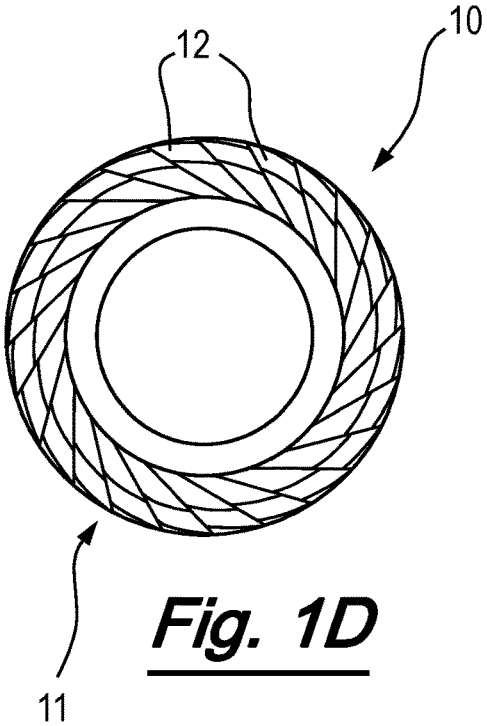
Figure 1C:
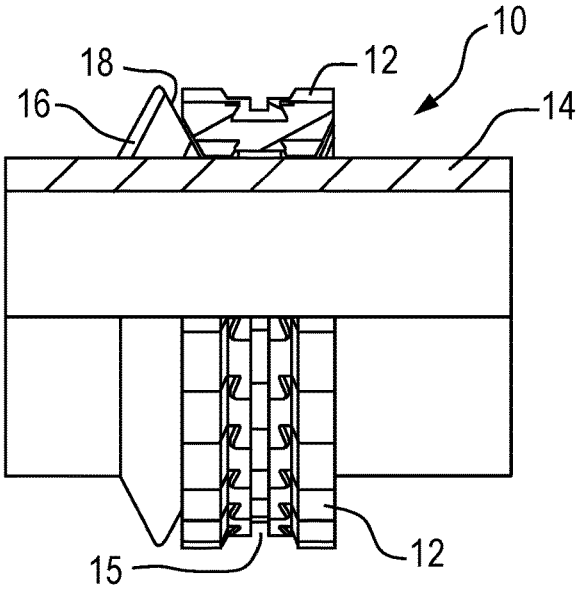
Figure 2A:
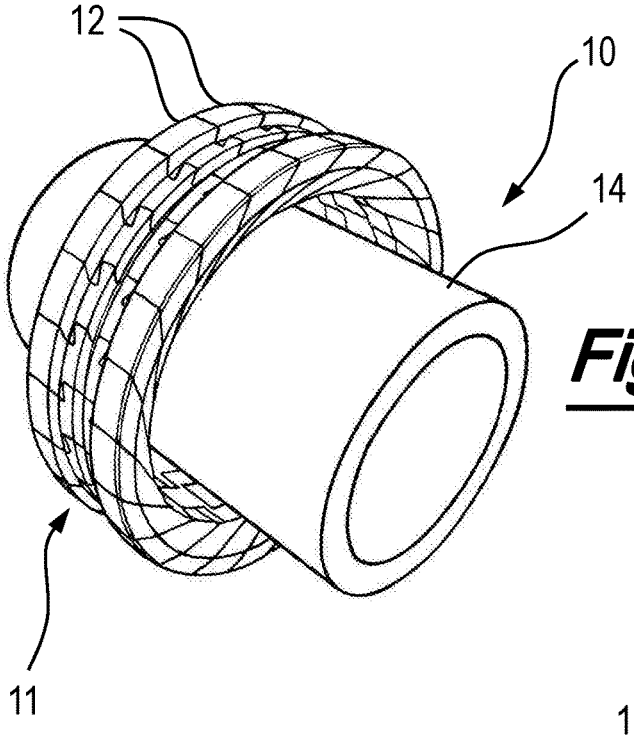
FIGS. 2A to 2D are respectively perspective, first side, part sectional and second side views of the apparatus of FIGS. 1A to 1D, shown in an expanded condition.
Figure 2B:
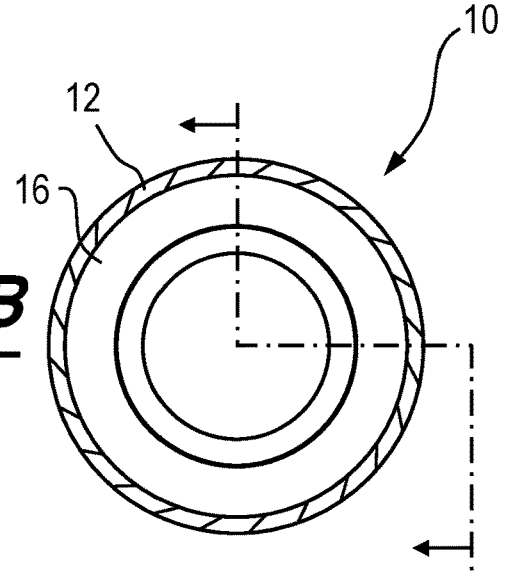
Figure 2D:
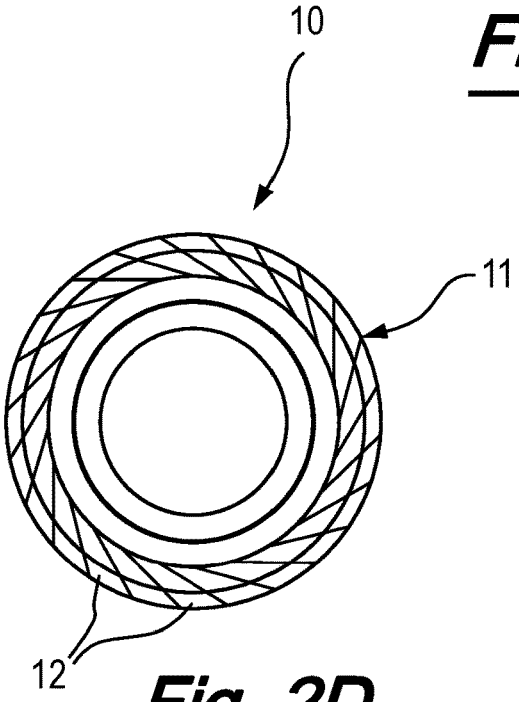
Figure 2C:
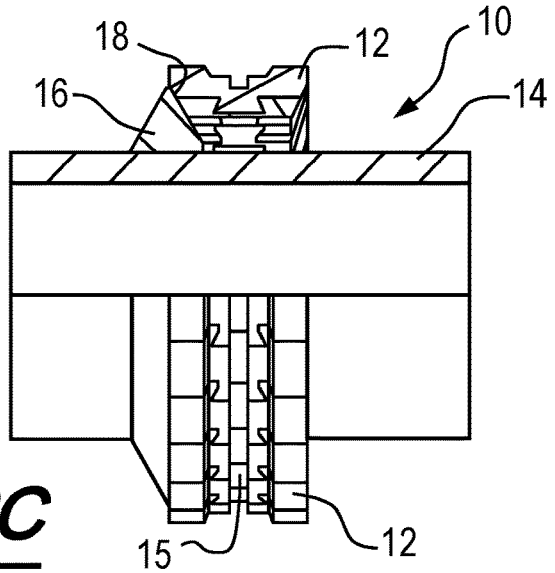

In the configuration shown in FIGS. 1 and 2, notional wedge-shaped segments are modified by removal of the tips 29 of the wedges, to provide a curved or arced inner surface 20 with radius $r_2$ when the ring is in its expanded condition shown in FIGS. 2A and 2D. The modification of the wedge-shaped elements can be thought of as an increase in diameter of an internal bore through the ring structure by $2(r_2-r_3)$, or a truncation of the inner diameter. This change in the inner diameter from the notional inner diameter $r_3$ to which the contact surfaces are tangential to a truncated inner diameter $r_2$, has the effect of changing an angle between the contact surfaces and the radial plane from the centre of the ring. Taking angle $\theta_2$ to be the angle described between the contact surface and a radial plane defined between the centre point of the ring structure and the point at which the orientation surface meets or intersects a circle at the radial position of the inner surface, $\theta_2$ is changed in dependence on the amount by which the segment has its inner diameter truncated. For the notional wedge shaped segment, the orientation planes of the contact surfaces are tangential to a circle at the inner diameter at $r_3$ (i.e. angle $\theta_2$ is 90 degrees). For the modified elements 12, the orientation planes of the contact surfaces instead intersect a circle at the (increased) inner diameter at $r_2$ and are inclined at a reduced angle $\theta_2$.

The angle $\theta_2$ at which the segment is inclined is related to the amount of material removed from the notional wedge-shaped segment, but is independent from the central angle $\theta_1$ of the wedge. Angle $\theta_2$ is selected to provide element dimensions suitable for manufacture, robustness, and fit within the desired annular volume and inner and outer diameters of the collapsed ring. As the angle $\theta_2$ approaches 90 degrees, a shallower, finer wedge profile is created by the element, which may enable optimisation of the collapsed volume of the ring structure. Although a shallower, finer wedge profile may have the effect of reducing the size of the gaps created at the inner surface of the ring in the collapsed condition and/or enabling a more compact collapsed condition, there are some consequences. These include the introduction of flat sections at the inner surfaces of the elements, which manifest as spaces at the inner diameter of the ring when in an expanded or partially expanded condition. When $\theta_2$=90 degrees, all the segments are purely tangential to inner diameter, the collapsed volume for a given outer diameter and inner diameter is most efficient, but the inner surface of the ring structure is polygonal with flat sections created by each segment. In some configurations, these flat sections may be undesirable. There may also be potential difficulties with manufacture of the elements and robustness of the elements and assembled ring structure. However, in many applications, where the profile of the inner surface of the expanded ring is not critical, for example when the inner diameter of the ring structure is floating, and/or the true inner diameter is defined by an actuation wedge profile rather than the inner surface of the ring, this compromise may not be detrimental to the operation of the apparatus, and the reduced collapse volume may justify an inclination angle $\theta_2$ of (or approaching) 90 degrees.

In the apparatus of FIGS. 1 to 4, the angle $\theta_2$ is 75 degrees. Relaxing $\theta_2$ to a reduced angle provides a smooth outer diameter and inner diameter profile to the expanded ring, as a portion of the inner circular arc is retained at the expense of slightly increased collapsed volume. It should be noted that the angle $\theta_2$ is independent from the angle $\theta_1$. Where the ring structure is desired to have a circular inner surface, preferred arrangements may have an angle $\theta_2$ which is in the range of (90 degrees-$2\theta_1$) to 90 degrees inclusive, and particularly preferred arrangements have an angle $\theta_2$ in the range of 70 degrees to 90 degrees (most preferably in the range of 73 degrees to 90 degrees). In general, to provide sufficient truncation of the inner diameter to retain a useful portion of an inner arc and provide a smooth inner surface to the ring structure, a maximum useful value of $\theta_2$ is (90 degrees-$\theta_1/2$). This would be 82.5 degrees in the described arrangements.

In other configurations, also in accordance with embodiments of the invention (and as will be described below) the geometry of the notional wedge-shaped segments forming the elements may be unmodified (save for the provision of functional formations such as for interlocking and/or retention of the elements), without the removal of material from the tip of the notional wedge-shaped segments. Such embodiments may be preferred when there is no requirement for the ring structure to have a circular inner surface.

As most clearly shown in FIGS. 4A to 4F, the first and second contact surfaces of the element have corresponding interlocking profiles 24 formed therein, such that adjacent elements can interlock with one another. In this case, the interlocking profiles comprise a dovetail groove 25 and a corresponding dovetail tongue 26. The interlocking profiles resist circumferential and/or radial separation of the elements in the ring structure, but permit relative sliding motion between adjacent elements. The interlocking profiles also facilitate smooth and uniform expansion and contraction of the elements during use. It will be appreciated that alternative forms of interlocking profiles, for example comprising recesses and protrusions of other shapes and forms, may be used within the scope of the invention.

The elements are also provided with inclined side wall portions 27, which facilitate deployment of the apparatus in use. The side wall portions are formed in an inverted cone shape which corresponds to the shape and curvature of the actuating cone wedges profiles when the apparatus is in its maximum load condition (typically at its optimum expansion condition).

Each element is also provided with a groove 28, and in the assembled ring structure, the grooves are aligned to provide a circular groove which extends around the ring. The groove accommodates a biasing element (not shown), for example a spiral retaining ring of the type marketed by Smalley Steel Ring Company under the Spirolox brand, or a garter spring. In this case, the biasing means is located around the outer surface of the elements, to bias the apparatus towards the collapsed condition shown in FIGS. 1A to 1D. Although one groove for accommodating a biasing means is provided in this embodiment, in alternative embodiments of the apparatus, multiple grooves and biasing means may be provided.

The apparatus 10 comprises a wedge member 16, which in this case is an annular ring having a conical surface 18 opposing one side of the ring structure 11. The wedge angle corresponds with the angle of the inclined conical side walls 27 of the elements. A corresponding wedge shaped profile (not shown) is optionally provided on the opposing side of the ring structure to facilitate expansion of the ring elements. In alternative embodiments of the invention this optional additional wedge may be substituted with an abutment shoulder.

Operation of the expansion apparatus will now be described. In the first, collapsed or unexpanded condition, shown most clearly in FIG. 1C, the elements are assembled in a ring structure 11 which extends to a first outer diameter. In this embodiment, and as shown in FIGS. 1B and 1C, the wedge member 16 defines the maximum outer diameter of the apparatus in the first condition. The elements are biased towards the unexpanded condition by a spiral retaining ring (not shown), and are supported on the inner surface by the outer surface of the cylinder 14.

In use, an axial actuation force is imparted on the wedge member 16. Any of a number of suitable means known in the art can be used for application of the axial actuation force, for example, the application of a force from an outer sleeve positioned around the cylinder. The force causes the wedge member 16 to move axially with respect to the cylinder, and transfer a component of the axial force onto the recessed side wall of the elements. The angle of the wedge transfers a radial force component to the elements 12, which causes them to slide with respect to one another along their respective contact surfaces.

The movement of the expanding elements is tangential to a circle defined around the longitudinal axis of the apparatus. The contact surfaces of the elements mutually support one another before, during, and after expansion. The radial position of the elements increases on continued application of the axial actuation force until the elements are located at a desired outer radial position. This radial position may be defined by a controlled and limited axial displacement of the wedge member, or alternatively can be determined by an inner surface of a bore or tubular in which the apparatus is disposed.

FIGS. 2A to 2D show clearly the apparatus in its expanded condition. At an optimal expansion condition, shown in FIGS. 2B and 2D, the outer surfaces of the individual elements combine to form a complete circle with no gaps in between the individual elements. The outer surface of the expansion apparatus can be optimised for a specific diameter, to form a perfectly round expanded ring (within manufacturing tolerances) with no extrusion gaps on the inner or outer surfaces of the ring structure. The design of the expansion apparatus also has the benefit that a degree of under expansion or over expansion (for example, to a slightly different radial position) does not introduce significantly large gaps.

It is a feature of the invention that the elements are mutually supported before, throughout, and after the expansion, and do not create gaps between the individual elements during expansion or at the fully expanded position. In addition, the arrangement of elements in a circumferential ring, and their movement in a plane perpendicular to the longitudinal axis, facilitates the provision of smooth side faces or flanks on the expanded ring structure. With deployment of the elements in the plane of the ring structure, the overall width of the ring structure does not change. This enables use of the apparatus in close axial proximity to other functional elements.

The apparatus has a range of applications, and the present invention extends the principles described above to an expanding rotating apparatus, including drill bits, mill bits, and other devices for cutting or removing material in a wellbore or subterranean formation.

Figure 5A:
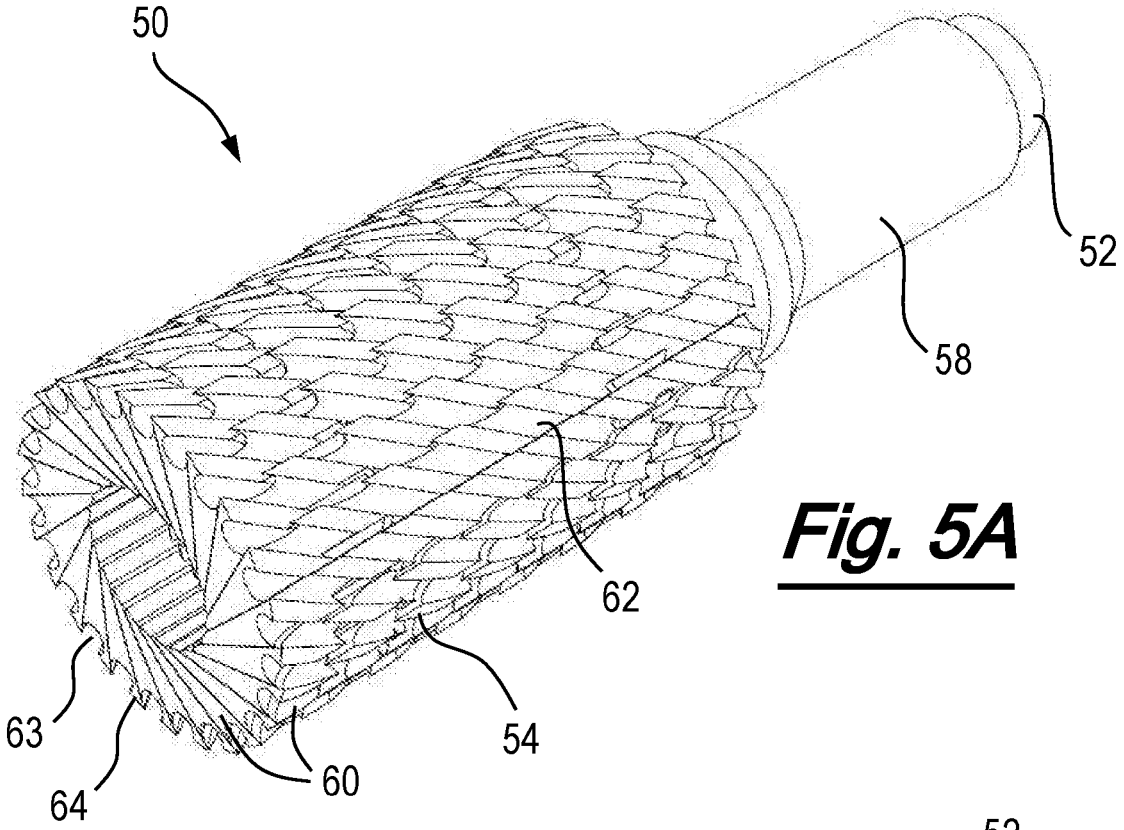
FIGS. 5A to 5C are respectively perspective, longitudinal sectional, and end views of an apparatus in accordance with an embodiment of the invention in a collapsed, run condition.
Figure 6A:
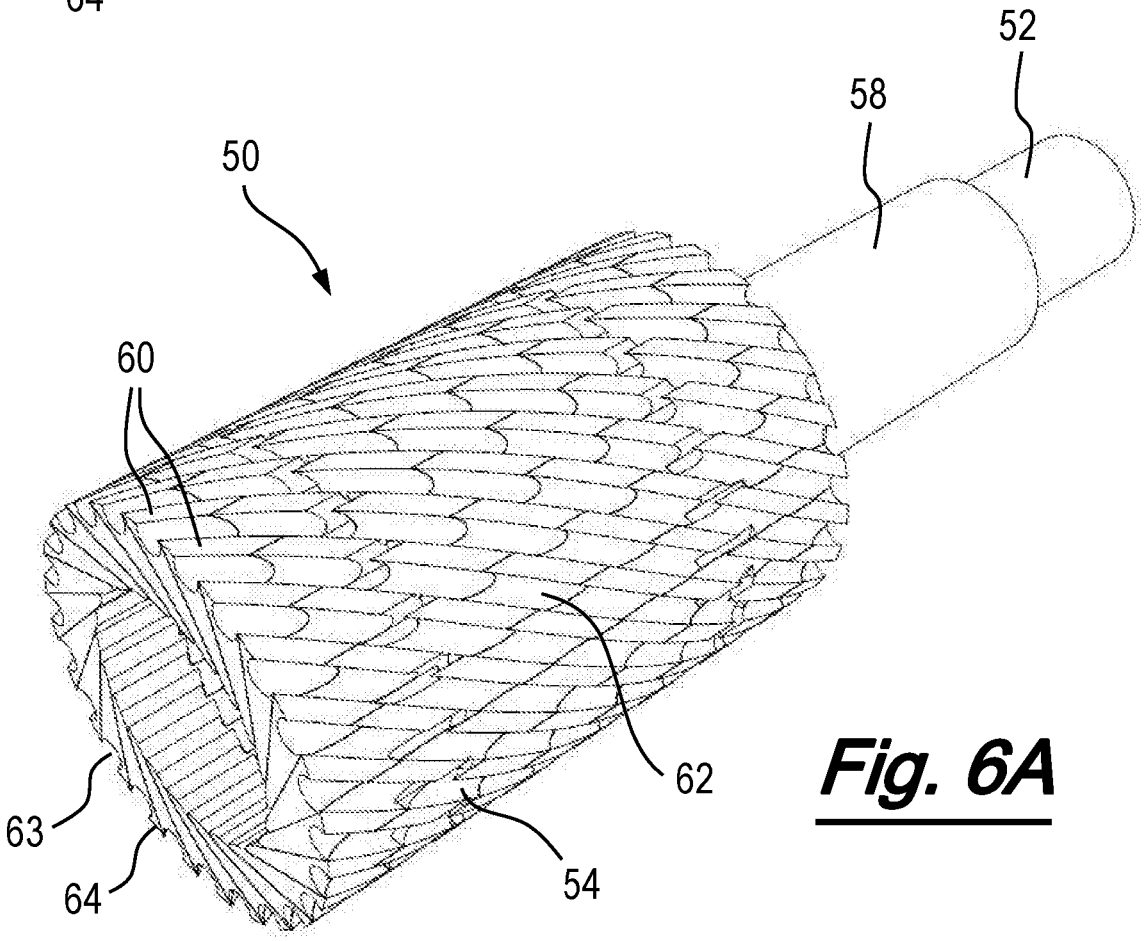
FIGS. 6A to 6C are respectively perspective, longitudinal sectional, and end views of the apparatus of FIGS. 5A to 5C in an expanded, operating condition.
Figure 5B:
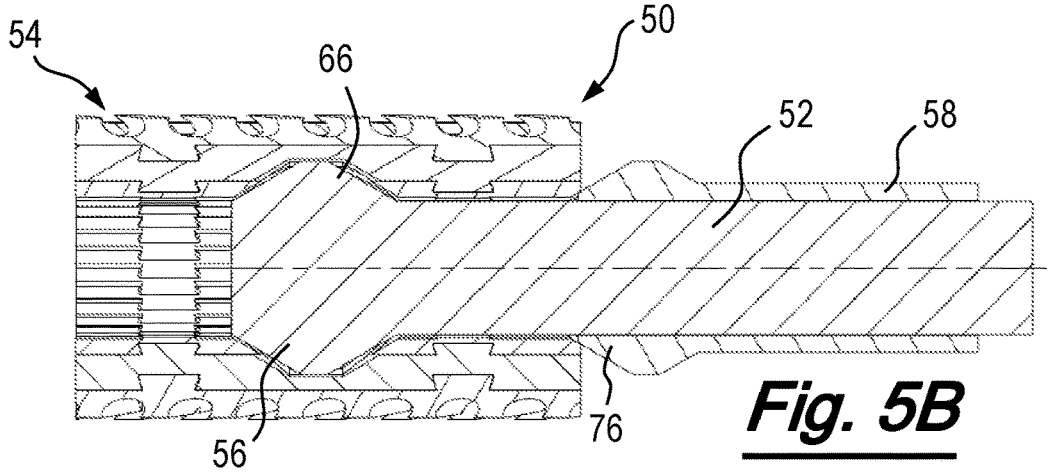
Figure 6B:
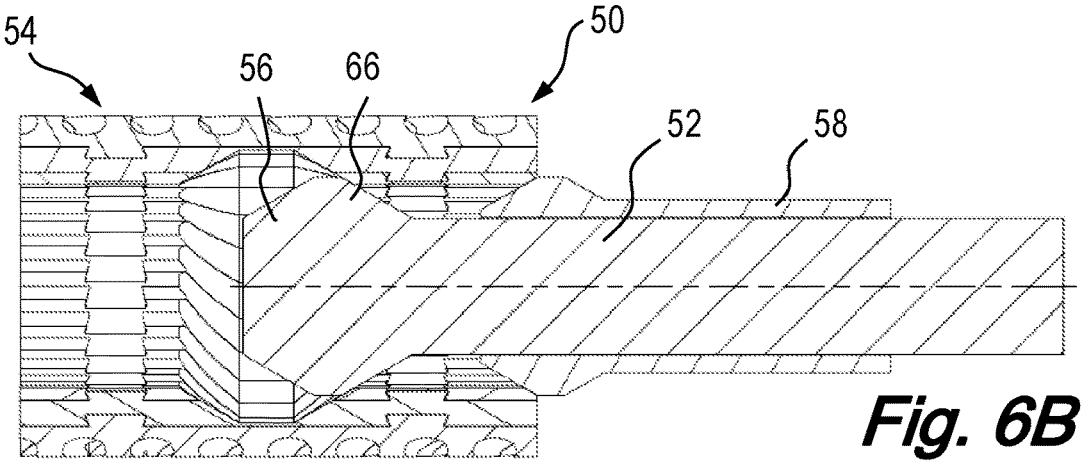
Figure 5C:
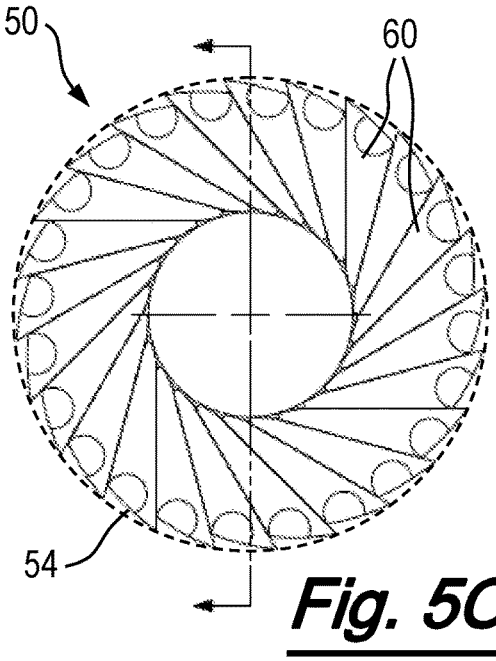
Figure 6C:
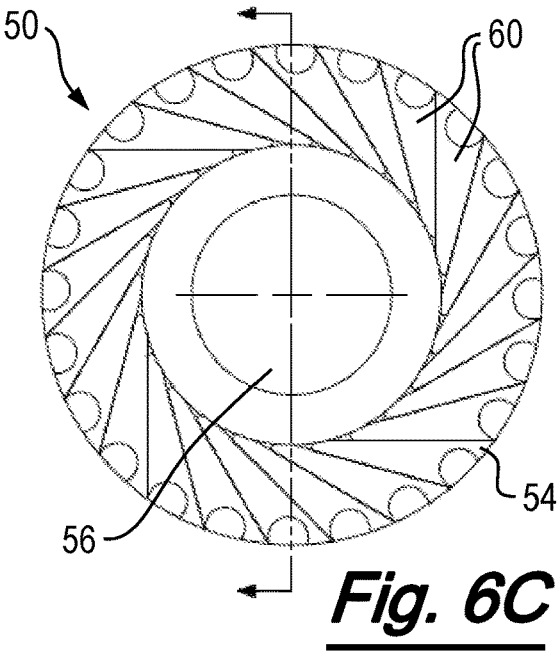

Referring now to FIGS. 5A to 6C, there will be described an expandable mill bit according to an embodiment of the invention. The expandable mill bit, generally depicted at 50, is shown in FIGS. 5A to 5C in a collapsed, run condition, in perspective, longitudinal sectional, and end views respectively. FIGS. 6A to 6C are equivalent views of the apparatus 50 in an expanded, operating condition.

The apparatus comprises a drive shaft 52, an expanding and collapsing ring structure, generally shown at 54 disposed around a leading end 56 of the shaft 52, and an actuation sleeve 58 disposed on the shaft.

The ring structure 54 is assembled from a plurality of elements 60. The elements 60 are similar to the elements 12, and their form and function will be understood from FIGS. 1 to 4 and the accompanying description. In particular, the elements 60 comprise inner and outer surfaces and first and second contact surfaces. The first and second contact surfaces are oriented in non-parallel planes, which are tangential to a circle centred on the longitudinal axis of the apparatus and concentric with the ring structure. The elements 60 also comprise corresponding interlocking profiles. The elements 60 comprise a pair of grooves for accommodating a pair of biasing springs (not shown).

In this embodiment, the outer surface of each element is provided with milling surface 62 defined by a series of grooves 63 and ridges 64 in their outer surfaces. The milling surface 62 is arranged such at that, in the optimum expanded condition shown in FIG. 6A, the grooves and ridges are aligned to provide a number of helically arranged grooves and ridges. The elements are formed from a material with properties (including hardness) suitable for milling or cutting through downhole components and/or subterranean formations. Alternatively, or in addition, the elements may be provided with a surface treatment or surface formations that have suitable properties for milling or cutting. In this embodiment, the apparatus is configured for side milling, although other configurations of cutting head, including forward or end milling surfaces may be features of alternative embodiments of the invention. It will also be appreciated that alternative forms of milling or cutting surface may be used in other embodiments of the invention. In this embodiment, the ring structure 54 is designed to have an outer diameter which corresponds to optimum milling diameter for particular operation. However, the apparatus also provides effective milling at diameters under-expanded and/or over-expanded diameters.

An important feature of the apparatus 50 is that it has the ability to transfer torque from the shaft and/or sleeve to the expanding ring structure. Located on the input drive shaft at a first end 56 of the ring structure 54 is an engaging formation in the form of a slotted conical wedge profile 66. The wedge profile defines a wedge surface which faces a first end of the ring structure, and interacts with the ring structure to expand and collapse the structure as will be described below. Slots in the conical wedge profile (not shown) correspond with ridges (not shown) formed in the inner surfaces of the elements 62 to form a splined coupling.

The actuation sleeve 58 is rotationally keyed with the input drive shaft 52, by a sliding pin (not shown). The sleeve 58 is able to slide with respect to the drive shaft 52 on application and/or release of an axial force, but is driven to rotate with the drive shaft. A first end of the actuation sleeve defines a slotted conical wedge profile 76, which interacts with an end of the ring structure to expand and collapse the ring structure as will be described below. Slots (not shown) in the conical wedge profile 76 correspond with ridges formed in the inner surfaces of the elements 60 to form a splined coupling.

Operation of the apparatus will now be described, with particular reference to FIGS. 5B and 6B. When the ring structure 54 is in its collapsed condition, shown in FIG. 5B, the outer surface of the ring structure is radially collapsed. The ring structure 54 is engaged with the conical wedge profiles 66, 76 via the arrangements of splines, and when the drive shaft 52 is driven to rotate, the ring structure rotates with the shaft.

When the milling tool is required to be expanded, an axial force is imparted between the shaft 52 and the actuation sleeve 58 which brings the conical wedge profiles closer together, transferring an axial force to the elements of the ring structure 54. As previously described with reference to FIGS. 1 to 4, the elements slide with respect to one another in a tangential direction of a circle concentric with the ring, and move to their radially extended positions. The outer surface of the ring structure 54 is moved to its expanded condition, as shown in FIG. 6B, and into contact with the inner surface of the wellbore (not shown) or wellbore component to mill or cut the surface.

Releasing the axial force separates the wedge profiles and causes the ring structure to collapse under the force of the retaining circumferential springs returning the tool to its collapsed condition, shown in FIG. 5B.

The mill bit 50 has the advantage that it can be run in hole in a first, run condition, in which the functional mill bit is in a collapsed form, with a first outer diameter. This enables it to pass through bore restrictions and/or tight corners or deviations in a wellbore, without difficulties associated with larger diameter tools. In addition, the collapsed condition of the tool reduces the likelihood of damage to sensitive or fragile components in the wellbore above the milling location.

When the tool is required to perform a milling function, the tool can be actuated to expand to an increased outer diameter to provide a functional milling surface. In addition, while the tool 50 has an optimum outer diameter, the expanding and collapsing mechanism can be used to set the tool at one of a range of outer diameters, including diameters over and under expanded from the optimum diameter. The diameter can also be changed dynamically during the operation. This enables progressive milling of downhole components or wellbore formations.

The tool 50 may be designed to be adjusted by an axial force imparted from surface, but other embodiments may comprise mechanisms for automated and/or remote adjustment of the separation of the wedge profiles on the core and sleeve position and the outer diameter. Such variants may include an electric motor which actuates rotation of a threaded connection to change the relative position of the wedges and the diameter of the ring structure.

The principles describe above have application to other systems in which a torque is applied to an expanding ring. For example, as an alternative to the milling application described with reference to FIGS. 5 and 6, the expanding ring could be configured as a drilling tool, a cutting tool, a reaming tool, an under reamer, a washover tool, or a hole opening tool. Embodiments of the invention may be provided with cutting surfaces or formations on their leading or trailing ends or faces, in addition to or instead of the cutting surface provided on the side (circumferential) surface of the tool.

The apparatus could also be configured as a casing drilling bit. In this application, the drilling bit could be run through the casing in a collapsed condition, and latched at the end of the casing. The drilling bit may then be expanded to a drilling diameter, and used to perform a casing drilling operation. When drilling is complete, the drilling bit could be collapsed, unlatched from the casing, and recovered. This enables the drilling bit to be replaced if desired, or the hole could be drilled ahead, without necessitating drilling through of the original casing drilling bit.

In some applications, for example, a drilling application or a reaming application, the apparatus may be configured as an intelligent tool, which is operable to be adjusted based on information collected during an operation. For example, information collected from logging while drilling (LWD) tools, or other drilling parameters, may be collected and input into a control system. The drilling or reaming system may then be responsive to the lithology of the formation, and the ring structure of the apparatus may be expanded or collapsed in situ in response to the signal from the control system. The tool may therefore be adjusted to drill or ream a larger or smaller hole that the notional gauge, for example, to compensate for salt and/or shale swelling, or borehole enlargement.

The invention provides a downhole apparatus and method of use. The apparatus comprises a plurality of elements assembled together to form a ring structure oriented in a plane around a longitudinal axis and a drive mechanism for effecting rotation of the ring structure with respect to a wellbore or subterranean formation. The ring structure is operable to be moved between a collapsed condition and a first expanded condition by movement of the plurality of elements on actuation by an axial force, and the ring structure comprises one or more surfaces or formations for cutting and/or removal of material from the wellbore or subterranean formation.

An important feature of the apparatus 50 is that at an optimal expansion condition, shown in FIGS. 2B and 2D, the outer surfaces of the individual elements combine to form a complete circle with no gaps in between the individual elements, and therefore the apparatus can provide a continuous cutting surface optimised for a specific diameter.

Tools of the invention may optionally be used with a variable diameter centralising and/or stabilising tool. The centralising and/or stabilising tool may be similar to the tool 50, with the outer surface of the elements designed to contact and engage with a borehole wall at a location axially displaced from the drilling, cutting, milling or reaming head. The centralising and/or stabilising tool may be provided with a bearing assembly to facilitate rotation of a mandrel with respect to its expanding ring structure, or to permit rotation of the drilling, cutting, milling or reaming head. The diameter of the centralising and/or stabilising tool can be controlled to provide a centralising and/or stabilising engagement force to support the wellbore operation. The centralising and/or stabilising tool can be used in a similar manner to stabilise, centre, or anchor a range of non-sealing devices or tools.

Various modifications to the above-described embodiments may be made within the scope of the invention, and the invention extends to combinations of features other than those expressly claimed herein. In particular, the different embodiments described herein may be used in combination, and the features of a particular embodiment may be used in applications other than those specifically described in relation to that embodiment.

The invention claimed is:

1. A downhole apparatus comprising:

a plurality of elements assembled together to form a ring structure oriented in a plane around a longitudinal axis; and a drive mechanism for effecting rotation of the ring structure with respect to a wellbore or subterranean formation;

wherein the ring structure is operable to be moved between a collapsed condition and an expanded condition by movement of the plurality of elements on actuation by an axial force;

wherein the ring structure comprises one or more surfaces or formations for cutting and/or removal of material from the wellbore or subterranean formation;

wherein each element of the ring structure comprises a first contact surface and second contact surface respectively in abutment with first and second adjacent elements;

wherein the first contact surface and the second contact surface of each element converge towards one another in a direction towards an inner surface of the ring structure.

2. The downhole apparatus according to claim 1, wherein the apparatus is normally collapsed, and is actuated to be expanded.

3. The downhole apparatus according to claim 1, wherein the one or more surfaces or formations are located at or on an expanded outer diameter of the ring structure.

4. The downhole apparatus according to claim 1, wherein the elements are configured to move between their expanded and collapsed radial conditions in a path which is tangential to a circle described around and concentric with the longitudinal axis.

5. The downhole apparatus according to claim 1, wherein the elements are configured to slide relative to one another along their respective contact surfaces.

6. The downhole apparatus according to claim 1, wherein the first contact surface and/or the second contact surface are oriented tangentially to a circle described around and concentric with the longitudinal axis.

7. The downhole apparatus according to claim 1, wherein each element comprises an interlocking profile which is configured to interlock with a corresponding interlocking profile on another element.

8. The downhole apparatus according to claim 1, wherein orientation planes of the first and second contact surfaces of the elements are tangential to a circle concentric with the ring structure.

9. The downhole apparatus according to claim 1, wherein the first and second contact surfaces of an element are oriented on first and second planes, which intersect an inner surface of the ring structure at first and second intersection lines, such that a sector of an imaginary cylinder is defined between the longitudinal axis and the intersection lines.

10. The downhole apparatus according to claim 1, wherein elements forming the ring structure are mutually supportive in the expanded condition of the apparatus.

11. The downhole apparatus according to claim 1, wherein the ring structure is a substantially solid ring structure in its expanded condition.

12. The downhole apparatus according to claim 1, wherein the apparatus comprises at least one formation configured to impart a radial expanding or collapsing force component to the elements of the ring structure from an axial actuation force.

13. The downhole apparatus according to claim 12, wherein the formation comprises a wedge or wedge profile.

14. The downhole apparatus according to claim 12, wherein at least one formation is configured to transmit torque to the ring structure.

15. The downhole apparatus according to claim 14, wherein the at least one formation comprises a splined arrangement.

16. The downhole apparatus according to claim 1, wherein the apparatus comprises a biasing means configured to bias the ring structure to its collapsed condition.

17. The downhole apparatus according to claim 1, wherein the apparatus is configured as a mill bit, a drill bit, or a cutting tool.

18. The downhole apparatus according to claim 1, wherein the apparatus is configured as a reamer or an underreamer.

19. The downhole apparatus according to claim 1, wherein the apparatus is configured as a washover tool or a hole opener.

20. The downhole apparatus according to claim 1, wherein the apparatus is configured as a casing drilling bit.

21. A method of use of the apparatus of claim 1 in an operation selected from the group comprising: a milling operation, a drilling operation; a cutting operation;

a reaming operation; an underreaming operation; a washover operation; a hole opening operation; or a casing drilling operation.

22. The method according to claim 21, comprising dynamically expanding and/or collapsing the ring structure of the apparatus in situ in the wellbore or subterranean formation.

23. The method according to claim 22, comprising dynamically expanding and/or collapsing the ring structure in response to operational parameters sensed, logged, measured or monitored during the operation.

24. The method according to claim 23, wherein at least some of the operational parameters are sensed, logged, measured or monitored downhole.

* * * * *